US008107650B2

(12) United States Patent
Fujiwara et al.

(10) Patent No.: US 8,107,650 B2
(45) Date of Patent: Jan. 31, 2012

(54) PIEZOELECTRIC ELECTROACOUSTIC TRANSDUCING DEVICE

(75) Inventors: Satoru Fujiwara, Osaka (JP); Yuka Nagata, Osaka (JP)

(73) Assignee: Hosiden Corporation, Yao-shi, Osaka (JP)

( * ) Notice: Subject to any disclaimer, the term of this patent is extended or adjusted under 35 U.S.C. 154(b) by 1222 days.

(21) Appl. No.: 11/878,651

(22) Filed: Jul. 26, 2007

(65) Prior Publication Data

US 2008/0049955 A1 Feb. 28, 2008

(30) Foreign Application Priority Data

Aug. 25, 2006 (JP) ..... 2006-228538

(51) Int. Cl.
*H04R 25/00* (2006.01)

(52) U.S. Cl. ..... 381/190; 381/398; 310/311; 310/324; 310/330; 310/331; 310/332; 311/333; 311/334; 311/349; 311/351; 311/353

(58) Field of Classification Search ..... None
See application file for complete search history.

(56) References Cited

U.S. PATENT DOCUMENTS 5,610,987 A * 3/1997 Harley ..... 381/67
2006/0039575 A1 2/2006 Wada

FOREIGN PATENT DOCUMENTS

JP 01 243700 A 9/1989
JP 02 007698 A 1/1990
JP 2001 339791 12/2001

* cited by examiner

*Primary Examiner* — Charles Garber
*Assistant Examiner* — Yasser Abdelaziez
(74) *Attorney, Agent, or Firm* — Bacon & Thomas, PLLC

(57) ABSTRACT

In a piezoelectric electroacoustic transducing device which is to be incorporated in an electronic apparatus such as a portable telephone, and which is used as a sound source, the sound pressure of the low-frequency range is improved, the productivity is improved, and acoustic characteristics are stabilized. A piezoelectric electroacoustic transducing device 10 has: a frame 15; a piezoelectric vibrator 11 in which piezoelectric elements 12A, 12B are bonded to a metal plate 13; and a plate- and ring-like support member 14 which supports a peripheral portion of the piezoelectric vibrator 11 on the frame 15. A step 14C corresponding to the thickness of the metal plate 13 is disposed in the support member 14, and the metal plate 13 is adhered to the inside of the step 14C in an embedded manner.

1 Claim, 3 Drawing Sheets

PIEZOELECTRIC ELECTROACOUSTIC TRANSDUCING DEVICE

BACKGROUND OF THE INVENTION

1. Field of the Invention

The present invention relates to a piezoelectric electroacoustic transducing device which is to be incorporated in an electronic apparatus such as a portable telephone, a PDA, a PC, or a digital camera, and which is used as a sound source.

2. Description of the Prior Art

FIG. 1 shows the structure of a usual piezoelectric electroacoustic transducing device. In the figure, 1 denotes a piezoelectric vibrator in which a piezoelectric element 2 configured by forming an electrode on each of the both faces of piezoelectric ceramics is applied to a diaphragm 3 configured by a metal disk. An outer peripheral portion 3A of the diaphragm 3 is overlayingly adhered to an inner peripheral portion 4A of a support member 4 configured by a plate- and ring-like resin film. An outer peripheral portion 4B of the support member 4 is fixed to a frame 5, and a peripheral portion of the piezoelectric vibrator 1 is supported on the frame 5 by the support member 4. When a driving voltage is applied between the electrodes of the piezoelectric element 2, the piezoelectric element 2 is radially displaced to cause deflection in the diaphragm 3, whereby the piezoelectric vibrator 1 is caused to vibrate with setting a fixation end of the outer periphery of the support member 4 as a fulcrum 6, to emit a sound. Such a conventional piezoelectric electroacoustic transducing device is disclosed in Japanese Patent Application Laying Open No. 2001-339791.

SUMMARY OF THE INVENTION

In the case where the outer peripheral portion 3A of the diaphragm 3 and the inner peripheral portion 4A of the support member 4 are adhered together while simply overlapping with each other as in the conventional piezoelectric electroacoustic transducing device, however, a thickness step 7 of the diaphragm 3 is formed between the piezoelectric element 2 which is a driving source of the piezoelectric vibrator 1, and the fulcrum 6, and there is a problem in that the sound pressure of the low-frequency range is lowered by a loss of the driving force of the piezoelectric vibrator 1 caused by the step 7. When the diaphragm 3 and the support member 4 are adhered together, the positional accuracy is hardly ensured, bonding misalignment easily occurs, and it is difficult to detect bonding misalignment. Consequently, there are further problems in that the productivity is lowered, and that acoustic characteristics are dispersed.

The invention has been conducted in view of the problems of a conventional piezoelectric electroacoustic transducing device. It is an object of the invention to support a peripheral portion of a piezoelectric vibrator by a support member on a frame so as not to form a thickness step between a piezoelectric element which is a driving source of the piezoelectric vibrator, and a fulcrum, whereby, in a piezoelectric electroacoustic transducing device, the sound pressure of the low-frequency range is improved, the productivity is improved, and acoustic characteristics are stabilized.

In order to attain the object, the invention provides a piezoelectric electroacoustic transducing device comprising: a frame; a piezoelectric vibrator in which a piezoelectric element is bonded to a metal plate; and a plate- and ring-like support member which supports a peripheral portion of the piezoelectric vibrator on the frame, wherein a step corresponding to a thickness of the metal plate is disposed in the support member, and the metal plate is adhered to an inside of the step in an embedded manner. A thickness step of the metal plate which is formed between the piezoelectric element that is a driving source of the piezoelectric vibrator, and the fulcrum of a fixation end of the outer periphery of the support member can be eliminated. A loss of the driving force of the piezoelectric vibrator caused by the thickness step can be eliminated. The sound pressure of the low-frequency range of the piezoelectric electroacoustic transducing device can be improved.

The step corresponding to the thickness of the metal plate and disposed in the support member functions as positioning means when the metal plate and the support member are adhered together, so that the positional accuracy is easily ensured, and bonding misalignment is prevented from occurring. Furthermore, bonding misalignment can be easily detected. Therefore, the productivity of the piezoelectric electroacoustic transducing device can be improved, and acoustic characteristics can be stabilized.

DETAILED DESCRIPTION OF THE PREFERRED EMBODIMENT

Figure 2:
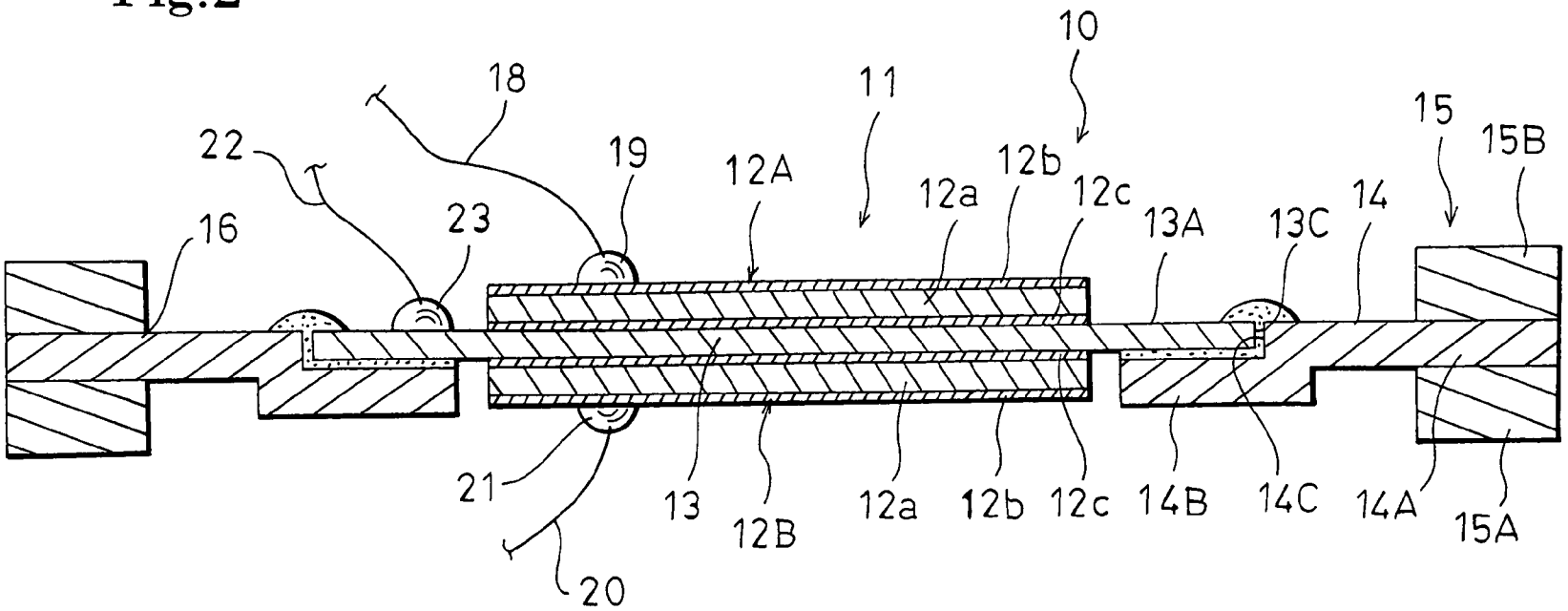
FIG. 2 is a section view showing the structure of a piezoelectric electroacoustic transducing device of an embodiment of the invention.

Hereinafter, an embodiment of the invention will be described with reference to the accompanying drawings. FIG. 2 shows the structure of a piezoelectric electroacoustic transducing device of the embodiment of the invention. As shown in FIG. 2, the piezoelectric electroacoustic transducing device 10 of the embodiment of the invention is configured by: a frame 15; a piezoelectric vibrator 11 in which thin disk-like first and second piezoelectric elements 12A, 12B are concentrically bonded to the both faces (front and rear faces) of a thin disk-like metal plate 13, respectively; and a ring-like support member 14 which is disposed between the piezoelectric vibrator 11 and the frame 15, and which supports a peripheral portion of the piezoelectric vibrator 11 on the frame 15.

The diameter (diameter of the piezoelectric vibrator 11) of the metal plate 13 is larger than the diameters of the first and second piezoelectric elements 12A, 12B. In FIG. 2, the first and second piezoelectric elements 12A, 12B having the same diameter (same surface area) are shown. Alternatively, first and second piezoelectric elements having different diameters may be used.

As the metal plate 13, for example, a metal disk which has a thickness of several tens of μm, and which is made of a nickel-iron alloy, a cupper alloy such as brass or phosphor bronze, stainless steel, or the like is preferably used.

In the first piezoelectric element 12A, thin-film like electrodes 12*b*, 12*c* are formed on the faces of a thin disk-like piezoelectric member 12*a*, respectively. In the second piezoelectric element 12B, similarly, thin-film like electrodes 12*b*, 12*c* are formed on the faces of a thin disk-like piezoelectric member 12*a*, respectively. As the piezoelectric members 12*a*, for example, piezoelectric ceramics of lead zirconate titanate (PZT) having a thickness of several tens of μm are preferably used.

For example, the electrodes 12*b*, 12*c* are formed as thin-film metal electrodes having a thickness of several μm by the evaporation method or the sputtering method, on the faces of the piezoelectric members 12*a*. Alternatively, the electrodes are formed as electrodes which has a thickness of several μm, and which is obtained by performing screen printing on a paste-like electrode material containing a silver component, and then firing it, on the faces of the piezoelectric members 12*a*.

The bonding between the first piezoelectric element 12A and the metal plate 13 is performed by sticking one face of the first piezoelectric element 12A on the side of the electrode 12*c* by an adhesive agent so that, for example, the electrode 12*c* which is on the side of the one face of the first piezoelectric element 12A is electrically conductive with the metal plate 13. Similarly, the bonding between the second piezoelectric element 12B and the metal plate 13 is performed by sticking one face of the second piezoelectric element 12B on the side of the electrode 12*c* by an adhesive agent so that, for example, the electrode 12*c* which is on the side of the one face of the second piezoelectric element 12B is electrically conductive with the metal plate 13.

As described above, the thin disk-like first and second piezoelectric elements 12A, 12B are concentrically bonded to the both faces of the thin disk-like metal plate 13, respectively, thereby configuring the piezoelectric vibrator 11 as a bimorph type one.

In the piezoelectric vibrator 11 of the bimorph type, a first lead wire 18 is mechanically fixed by a solder 19 to the non-bonding electrode 12*b* of the first piezoelectric element 12A to be electrically connected thereto, a second lead wire 20 is mechanically fixed by a solder 21 to the non-bonding electrode 12*b* of the second piezoelectric element 12B to be electrically connected thereto, and a third lead wire 22 is mechanically fixed by a solder 23 to one face of an outer peripheral portion 13A of the metal plate 13 to be electrically connected thereto.

In a state where the first and second lead wires 18, 20 are short-circuited together, when a driving voltage is applied from an external circuit between the lead wires and the third lead wire 22, or when the driving voltage is applied from the external circuit between the electrodes 12*b*, 12*c* formed on the faces of the first piezoelectric element 12A, and between the electrodes 12*b*, 12*c* formed on the faces of the second piezoelectric element 12B, the first and second piezoelectric elements 12A, 12B are radially displaced. This displacement causes the metal plate 13 to deflect, whereby the piezoelectric vibrator 11 vibrates with setting a fixation end of the outer periphery of the support member 14 as a fulcrum 16, to generate a sound.

A predetermined high voltage is previously applied to the first and second piezoelectric elements 12A, 12B so that the elements are polarized in the thickness direction, thereby performing an electric polarizing process. When an electric field in the same direction as the polarization direction is applied to the first piezoelectric element 12A, an electric field in the direction opposite to the polarization direction is applied to the second piezoelectric element 12B in order to prevent the displacements of the first and second piezoelectric elements 12A, 12B from off-setting each other.

The frame 15 is configured by first and second frame members 15A, 15B which clamp an outer peripheral portion 14A of the support member 14 that will be described later, vertically (in the front and rear direction). The frame members have the same structure. Therefore, only the first frame member 15A will be described, and the description of the second frame member 15B will be omitted. For example, the first frame 15A is formed into a ring-like shape by concentrically opening a circular through hole in a middle portion of a resin or metal plate having a thickness of several hundreds of μm. The inner diameter of the first frame member 15A is larger than the outer diameter (diameter of the metal plate 13) of the piezoelectric vibrator 11, and smaller than the outer diameter of the support member 14 which will be described later. In the external shape (size) of the first frame member 15A, one edge has a length which is substantially equal to the outer diameter of the support member 14 that will be described later. Usually, the external shapes of the first and second frame members 15A, 15B, i.e., the frame 15 are often formed into a circular shape, or alternatively may be formed into a rectangular shape or a semicylindrical shape.

The support member 14 is configured by a ring-like resin film which has a plate-like shape. In the support member 14, for example, a resin film having a thickness of several tens of μm of a polyethylene terephtalate (PET) resin, a polyethylene naphthalate (PEN) resin, a polyether imide (PEI) resin, a polyimide (PI) resin, a polyamide (PA) resin, or the like is preferably used because such a resin film is excellent in rigidity, easily molded, and low in material cost. Alternatively, a resin film having a two-layer structure which is formed by bonding together two such ring-like resin films which have a plate-like shape may be used. The inner diameter of the support member 14 is larger than the diameters of the first and second piezoelectric elements 12A, 12B, and smaller than the outer diameter of the metal plate 13 (the outer diameter of the piezoelectric vibrator 11). The outer diameter of the support member 14 is substantially equal to the dimension of the outer diameter of the frame 15.

In the support member 14, a step 14C corresponding to the thickness of the metal plate 13 is disposed along the external shape of the metal plate 13, so that the metal plate 13 can be embedded inside the step 14C.

The piezoelectric electroacoustic transducing device 10 of the embodiment of the invention is assembled by using the above-described components in the following manner. The metal plate 13 of the piezoelectric vibrator 11 is embedded (fitted) inside the step 14C which corresponds to the thickness of the metal plate 13, and which is disposed in the support member 14. The outer peripheral portion 13A of the metal plate 13 is overlaid with an inner peripheral portion 14B which is inside the step 14C of the support member 14. The step 14C of the support member 14, a peripheral end face 13C of the metal plate 13 which is opposed thereto, one face of the inner peripheral portion 14B which is inside the step 14C of the support member 14, and one face of the outer peripheral portion 13A of the metal plate 13 which is opposed thereto are continuously adhered together by, for example, a rubber elastic adhesive agent of a JIS-A hardness of 40 or less, to concentrically attach the support member 14 to the periphery of the piezoelectric vibrator 11. In the attachment state, the thickness of the metal plate 13 is absorbed by the step 14C of the support member 14, and an upper face of the metal plate 13 is substantially flush with an upper face of the support member 14 which is outside the step 14C. In this state, the metal plate 13, the portion of the support member 14 which is outside the step 14C, and the fulcrum 16 are positioned on a substantially straight line. The step 14C disposed in the support member 14 functions as positioning means when the metal plate 13 and the support member 14 are adhered together, so that the positional accuracy is easily ensured, bonding misalignment is prevented from occurring, and bonding misalignment is easily detected. Therefore, the productivity of the piezoelectric electroacoustic transducing device 10 of the embodiment of the invention can be improved, and the acoustic characteristics can be stabilized. The same adhesive agent is applied also to the interface between the bonding face of the metal plate 13 with respect to the support member 14, and the face which is in one face of the support member 14 that is substantially flush with the bonding face, and that functions as a bonding face with respect to the metal plate 13, and which is outside the step 14C disposed in the one face.

The outer peripheral portion 14A of the support member 14 which is attached to the periphery of the piezoelectric vibrator 11 as described above is overlaid with the first frame member 15A which is in the lower side, and adhered thereto by, for example, a rubber elastic adhesive agent of a JIS-A hardness of 10 or less, or an acrylic adhesive agent so that the piezoelectric vibrator 11 is concentrically attached to the inner side of the first frame member 15A via the support member 14. Thereafter, the second frame member 15B in the upper side is overlaid with the outer peripheral portion 14A of the support member 14, and adhered thereto by the same adhesive agent. The outer peripheral portion 14A of the support member 14 is fixed to the frame 15 in a state where the outer peripheral portion is clamped between the first and second frame members 15A, 15B. A semifinished product of the piezoelectric electroacoustic transducing device 10 of the embodiment of the invention is assembled in which the piezoelectric vibrator 11 is vertically vibratably supported via the support member 14 on the inside of the frame 15 in which the upper and lower faces are opened.

After the semifinished product of the piezoelectric electroacoustic transducing device 10 of the embodiment of the invention is assembled as described above, the first lead wire 18 is fixed and connected by soldering to the non-bonding electrode 12*b* of the first piezoelectric element 12A, and the second lead wire 20 is fixed and connected by soldering to the non-bonding electrode 12*b* of the second piezoelectric element 12B. Furthermore, the third lead wire 22 is fixed and connected by soldering to the one face of the outer peripheral portion 13A of the metal plate 13 which is inside the step 14C of the support member 14, whereby the assembling of the piezoelectric electroacoustic transducing device 10 of the embodiment of the invention is completed.

Alternatively, the piezoelectric electroacoustic transducing device 10 of the embodiment of the invention may be assembled in the following manner. The outer peripheral portion 14A of the support member 14 is overlayingly adhered to the first frame member 15A which is the lower side. Either before or after the second frame member 15B is overlayingly adhered to the outer peripheral portion 14A of the support member 14, the metal plate 13 of the piezoelectric vibrator 11 is embedded inside the step 14C of the support member 14, and the outer peripheral portion 13A of the metal plate 13 is overlayingly adhered to the inner peripheral portion 14B which is inside the step 14C of the support member 14. Also in this case, the solder connections of the first to third lead wires 18, 20, 22 are performed after the assembling of the semifinished product of the piezoelectric electroacoustic transducing device 10 of the embodiment of the invention. In the bonding between the outer peripheral portion 13A of the metal plate 13 of the piezoelectric vibrator 11 and the inner peripheral portion 14B which is inside the step 14C of the support member 14, a soft adhesive agent was used so that the metal plate 13 easily deflects, for purposes of broadening of the frequency characteristics, and the like. In the fixation of the outer peripheral portion 14A of the support member 14 to the first and second frame members 15A, 15B, i.e., the frame 15, a hard adhesive agent which has a high adhesive strength, and which exhibits a high durability was used so that, when the piezoelectric vibrator 11 is driven, the piezoelectric vibrator 11 and the support member 14 do not disengage from the frame 15. Alternatively, a soft adhesive agent may be used so that a gap which may cause leakage of sound is not formed between the outer peripheral portion 14A of the support member 14 and the frame 15. The connections of the first to third lead wires 18, 20, 22 may be realized by other connecting means such as welding or a conductive adhesive agent in place of the soldering.

In the piezoelectric electroacoustic transducing device 10 of the embodiment of the invention, the circular openings are formed in the upper and lower faces (front and rear faces) of the frame 15, and hence a sound can be emitted from either of the faces. Namely, a sound can be emitted from any one of the side of the piezoelectric vibrator 11 where the first piezoelectric element 12A exists, and that where the second piezoelectric element 12B exists. The frame 15 has a two-piece structure consisting of the first and second frame members 15A, 15B. In order to more surely integrate the first and second frame members 15A, 15B with each other, and to surely maintain the integration, the outer periphery of the frame 15 may be covered by a metal cover or the like to clamp the first and second frame members 15A, 15B. The external shape of the frame 15 is formed into a circular shape. Alternatively, the external shape may be formed into a rectangular shape or a semi-cylindrical shape. A frame member having a one-piece structure may be used as the frame 15. In this case, a stepped face is disposed in the inner wall face, and the outer peripheral portion 14A of the support member 14 is adhered to the stepped face, whereby the piezoelectric vibrator 11 can be supported. A ring-like press member may be used so that the outer peripheral portion 14A of the support member 14 is clamped by the press member and the stepped face.

For example, the piezoelectric electroacoustic transducing device 10 of the embodiment of the invention may be mounted inside a sound hole disposed in a housing of a portable telephone, and emit a sound in the front direction with respect to the flat face portion of the piezoelectric vibrator 11. Alternatively, a sound may be emitted in a lateral direction. The first to third lead wires 18, 20, 22 are electrically connected to predetermined electrodes of a circuit board, and the device is used as a piezoelectric speaker. Preferably, a pair of terminals are integrally disposed on the first or second frame member 15A or 15B of the frame 15, the first and second lead wires 18, 20 are fixed and connected by soldering to one of the metal terminals, the remaining third lead wire 22 is fixed and connected by soldering to the other terminal, and the first to third lead wires 18, 20, 22 are electrically connected via the pair of terminals to the predetermined electrodes of the circuit board.

Figure 1:
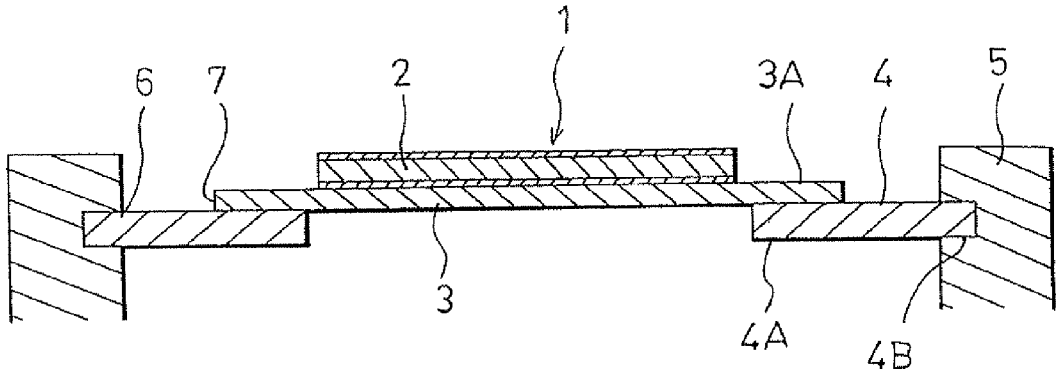
Fig. 1 (PRIOR ART)
FIG. 1 is a section view showing the structure of a usual piezoelectric electroacoustic transducing device of a conventional art.

In the piezoelectric electroacoustic transducing device 10 of the embodiment of the invention, when the driving voltage is applied from the external circuit between the electrodes 12*b*, 12*c* formed on the faces of the first piezoelectric element 12A, and between the electrodes 12*b*, 12*c* formed on the faces of the second piezoelectric element 12B, the first and second piezoelectric elements 12A, 12B are radially displaced. This displacement causes the metal plate 13 to deflect, whereby the piezoelectric vibrator 11 vibrates with setting the fixation end of the outer periphery of the support member 14 as the fulcrum 16. In this case, since the step 14C corresponding to the thickness of the metal plate 13 is disposed in the support member 14 and the metal plate 13 of the piezoelectric vibrator 11 is adhered to the inside of the step 14C in an embedded manner, a thickness step (see the reference numeral 7 of FIG. 1) of the metal plate which is formed in a conventional art structure between the first and second piezoelectric elements 12A, 12B serving as a driving source of the piezoelectric vibrator 11, and the fulcrum 16 of the fixation end of the support member 14 can be eliminated, and the first and second piezoelectric elements 12A, 12B serving as a driving source of the piezoelectric vibrator 11, and the fulcrum 16 of the outer periphery fixation end of the support member 14 are positioned on a substantially straight line. The driving force of the piezoelectric vibrator 11 can be easily concentrated on the fulcrum 16, and a loss of the driving force of the piezoelectric vibrator 11 caused by the thickness step of the metal plate can be eliminated. The sound pressure of the low-frequency range of the piezoelectric electroacoustic transducing device 10 can be improved.

Figure 3:
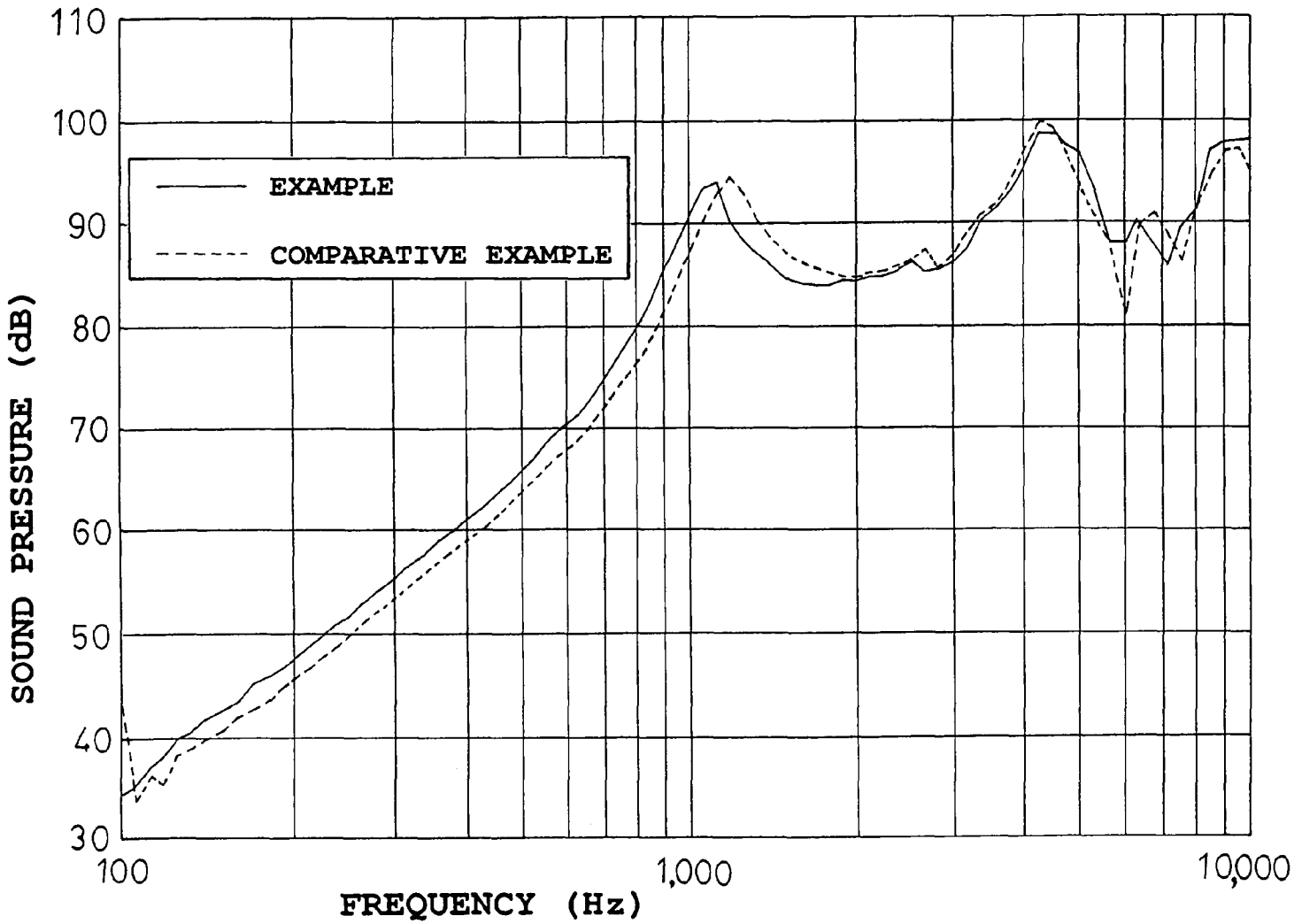
FIG. 3 is a graph showing frequency-sound pressure characteristics of the piezoelectric electroacoustic transducing device of the embodiment of the invention, and a comparative example to be compared therewith.

FIG. 3 is a graph showing frequency-sound pressure characteristics of a piezoelectric electroacoustic transducing device (hereinafter, referred to as example) of an example of the invention having the same structure as the above-described piezoelectric electroacoustic transducing device 10, and a conventional piezoelectric electroacoustic transducing device (hereinafter, referred to as comparative example). In the figure, the example is indicated by the solid line, and the comparative example by the broken line.

The comparative example has the same structure as the example except that the step 14C corresponding to the thickness of the metal plate 13 is not disposed in the support member 14.

Each of the example and the comparative example was disposed at a predetermined position, and a microphone was disposed at a position separated by 10 cm from the sound source. A driving voltage of several volts was applied between the electrodes 12*b*, 12*c* formed on the faces of the first piezoelectric element 12A, and between the electrodes 12*b*, 12*c* formed on the faces of the second piezoelectric element 12B, and frequency-sound pressure characteristics were measured. As apparent from FIG. 3, in the example, it will be seen that a higher sound pressure level is obtained in a frequency of 1 kHz or lower as compared with the comparative example.

As apparent from the above description, in the piezoelectric electroacoustic transducing device 10 of the embodiment of the invention, the step 14C corresponding to the thickness of the metal plate 13 is disposed in the support member 14, and the metal plate 13 of the piezoelectric vibrator 11 is adhered to the inside of the step 14C in an embedded manner. Therefore, a thickness step (see the reference numeral 7 of FIG. 1) of the metal plate which is formed in a conventional art structure between the first and second piezoelectric elements 12A, 12B serving as a driving source of the piezoelectric vibrator 11, and the fulcrum 16 of the fixation end of the support member 14 can be eliminated. Therefore, a loss of the driving force of the piezoelectric vibrator 11 caused by the thickness step of the metal plate can be eliminated, and the sound pressure of the low-frequency range of the piezoelectric electroacoustic transducing device can be improved. The step 14C disposed in the support member 14 and corresponding to the thickness of the metal plate 13 functions as positioning means when the metal plate 13 and the support member 14 are adhered together, so that the positional accuracy is easily ensured, bonding misalignment is prevented from occurring, and bonding misalignment is easily detected. Therefore, the productivity of the piezoelectric electroacoustic transducing device can be improved, and the acoustic characteristics can be stabilized. Consequently, the embodiment can provide a piezoelectric electroacoustic transducing device in which the sound pressure of the low-frequency range and the productivity are improved and the acoustic characteristics can be stabilized.

Although a preferred embodiment of the invention has been described, the invention is not restricted to this, and may be variously modified and implemented without departing the spirit. For example, the invention can be used also in a piezoelectric electroacoustic transducing device of the unimorph type in which a piezoelectric element is bonded to only one face of a metal plate.

What is claimed is:

1. A piezoelectric electroacoustic transducing device comprising:

a frame;

a piezoelectric vibrator in which a piezoelectric element is bonded to a metal plate;

a plate- and ring-like support member which supports a peripheral portion of said piezoelectric vibrator on said frame;

a step corresponding to a thickness of said metal plate disposed in said support member, and said metal plate being adhered to an inside of said step in an embedded manner; and an outer peripheral portion, which is disposed more outwardly than said step of said support member and includes a portion to be fixed to said frame, and said outer peripheral portion being substantially flush with said metal plate.

* * * * *